United States Patent [19]

Hubis et al.

[11] Patent Number: 4,769,515

[45] Date of Patent: Sep. 6, 1988

[54] PRIMARY TRANSMISSION LINE CABLE

[75] Inventors: Paul E. Hubis, Newark, Del.; James G. Vana; Stephen C. Miller, both of Austin, Tex.

[73] Assignee: W. L. Gore & Associates, Newark, Del.

[21] Appl. No.: 68,742

[22] Filed: Jun. 25, 1987

Related U.S. Application Data

[63] Continuation of Ser. No. 848,881, Apr. 7, 1986, abandoned.

[51] Int. Cl.[4] ..... H01B 7/00

[52] U.S. Cl. ..... 174/110 R; 174/34; 174/106 R; 174/119 R; 174/126.2; 333/236; 361/307

[58] Field of Search ..... 174/34, 36, 105 R, 106 R, 174/119 R, 119 C, 126 CP, 110 R, 143; 361/303, 307, 323; 333/236

[56] References Cited

U.S. PATENT DOCUMENTS

| | | | |
|---|---|---|---|
| 61,325 | 1/1867 | De Morat | 174/105 R |
| 1,231,568 | 7/1917 | Clark | 174/119 R |
| 1,438,349 | 6/1976 | Winterborn | 174/126 CP |
| 1,705,949 | 3/1929 | Williams | 174/106 R |
| 1,743,506 | 1/1930 | Watson et al. | 174/119 R |
| 2,041,147 | 5/1936 | Preisach | 174/126 CP |
| 2,379,942 | 7/1945 | Webber | 174/88 C |
| 2,594,983 | 4/1952 | Pease | 174/106 R |
| 2,849,526 | 8/1958 | Brockbank | 174/105 R |
| 2,852,596 | 9/1958 | Prince | 174/73 R |
| 2,955,968 | 10/1960 | Henning | 174/105 R |
| 2,967,902 | 1/1961 | Pasini | 174/102 R |
| 2,998,840 | 9/1961 | Davis | 174/106 R X |
| 3,090,825 | 5/1963 | Volk | 174/109 |
| 3,162,717 | 12/1964 | Lentz | 174/36 |
| 3,219,951 | 11/1965 | Clark | 333/79 |
| 3,261,907 | 7/1966 | Morrison | 174/115 |
| 3,379,824 | 4/1968 | Kempf | 174/105 R |
| 3,409,734 | 11/1968 | De Vine et al. | 174/34 |
| 3,795,760 | 3/1974 | Raw et al. | 174/126 CP X |

FOREIGN PATENT DOCUMENTS

| | | |
|---|---|---|
| 824615 | 12/1959 | United Kingdom . |
| 914498 | 1/1963 | United Kingdom . |

*Primary Examiner*—Morris H. Nimmo
*Attorney, Agent, or Firm*—Dena Meyer

[57] ABSTRACT

The present invention relates to single and twisted pair transmission line wires wherein the effective electrical diameter of the primary conductor is increased. This is accomplished by wrapping conductive foil or conductive foil laminated to a substrate layer onto a primary conductor with a diameter less than 20 mils wherein the foil is in contact with the conductor and has an outer insulating cover.

This may be done by either spiral wrapping or by longitudinal wrapping around the electrical conductor. This invention provides a desired characteristic impedance along the length of the wire(s) and allows easy removal for standard termination and increased cut-through resistance.

7 Claims, 2 Drawing Sheets

PRIMARY TRANSMISSION LINE CABLE

This application is a continuation of application Ser. No. 848,881 filed Apr. 7, 1986 now abandoned.

BACKGROUND OF THE INVENTION

This invention relates to the manufacture of twisted pair and single transmission line wires wherein the effective electrical diameter of the primary conductor is increased thereby providing a desired characteristic impedance along the length of the wire and allowing the wires to be terminated using standard termination equipment. This invention is particularly useful for solderless wrap connections to printed circuit boards or panels and for twisted wire and single wire interconnections.

Prior to this invention, transmission wire with a low impedance (less than 100 ohms) was not available for use with standard termination equipment. Typically, a primary conductor with a diameter greater than 20 mils had to be selected in order to achieve a low characteristic impedance. Only a thin wall of insulation could be wrapped around the primary conductor without increasing the characteristic impedance. Since only a thin wall of insulation could be used, there was poor cut-through resistance of this outer wall of insulation and other stripping difficulties.

Because of the low cut-through and abrasion resistance of these thin outer insulation walls, it was often necessary to apply a protective jacket over the wire. This further aggravated the stripping problem as the jacket first had to be removed during termination. During removal, the primary conductor is frequently damaged by the stripping blades. These difficulties have been substantially eliminated by the present invention.

SUMMARY OF THE INVENTION

The present invention relates to single and twisted pair transmission line wires wherein the effective electrical diameter of the primary conductor is increased. This is accomplished by wrapping conductive foil or a conductive foil laminated to a substrate layer onto a primary conductor with a diameter less than 20 mils wherein the conductive foil is in contact with the conductor. An outer layer of insulation may then be applied over the foil and primary conductor.

The foil or foil laminate may be applied by either spiral wrapping or by longitudinal wrapping around the primary conductor. This invention provides a desired characteristic impedance along the length of the wire and allows easy removal for standard termination and increased cut-through resistance.

DESCRIPTION OF THE PREFERRED EMBODIMENTS

The present invention requires that the effective electrical diameter of the primary conductor be increased by wrapping conductive foil or conductive foil laminated to a substrate onto a primary conductor of less than 20 mils wherein the foil is in contact with the conductor. This may be accomplished by conventional wire wrapping techniques and equipment.

The primary conductor with conductive foil or laminate in contact with it is able to maintain a low characteristic impedance and still be compatible with standard termination equipment and printed circuit boards.

A thicker layer of outer insulation may be applied over this invention and will not affect the characteristic impedance. This provides increased cut-through resistance. Conventional stripping equipment may be used with the present invention and the thicker layer of outer insulation is easily removed for termination. Standard stripping equipment is available from E.P.E. Technology of Manchester, N.H., and Eubanks of Monrovia, Calif.

This invention also provides benefits for applications in state of the art electronic equipment. The primary conductor with a diameter of less than 20 mils is compatible with terminal and grid spacings of printed circuit boards (0.025 square inch terminal with grid spacing 0.100 inches).

An inventive embodiment may be used either as a single insulated wire or two insulated wires may be twisted together and be used as a pair of twisted wires.

Figure 1:
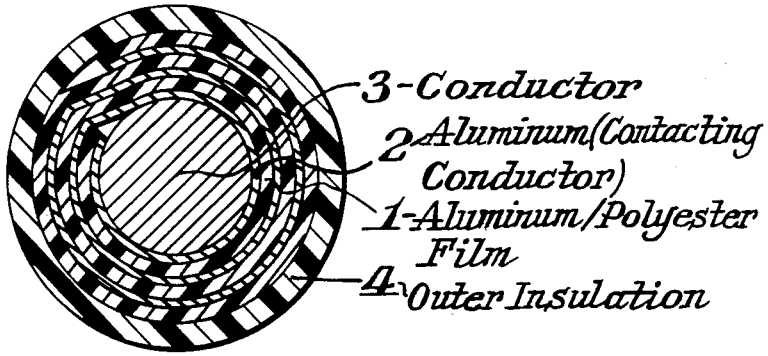
FIG. 1 is a schematic representation of a cross-section of a single insulated wire according to the invention.

Referring to the cross-sectional view of a single insulated wire depicted in FIG. 1, conductive metal foil laminate 1 is spirally wrapped around primary conductor 3 with the metal foil 2 facing into and in continuous contact with the primary conductor 3 making electrical contact between primary conductor 3 and foil 2. The preferred metal foil laminate comprises aluminum foil bonded to polyester or polyimide base film 1 or aluminum foil bonded to a film of expanded polytetrafluoroethylene 1. The primary conductor may have a single wrapping of metal foil or it may have a plurality of wrappings, depending on the desired thickness of the wall, as depicted in FIG. 1. Additional insulation 4 is applied over the top of the metal foil laminate wrapping.

Figure 2:
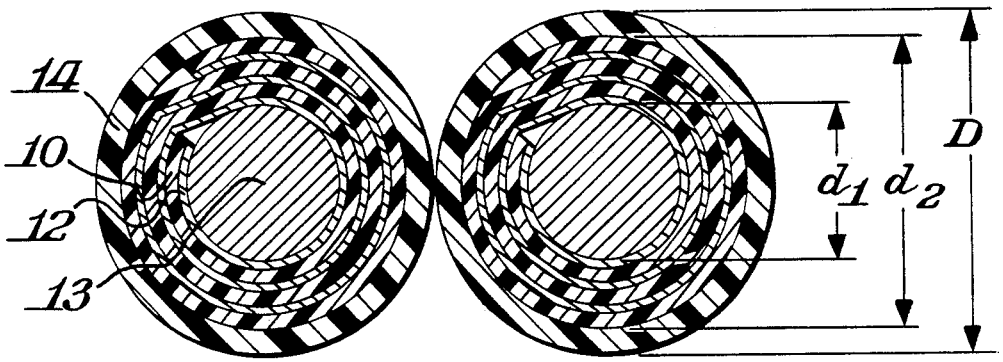
FIG. 2 is a schematic representation of a cross-section of a twisted pair of insulated wires according to the invention.

FIG. 2 shows a cross-sectional view of a twisted pair of insulated wires in which conductive metal foil laminate 10 is spirally wrapped around each primary conductor 13 with the metal foil 12 facing into the wires and in continuous contact with primary conductors 13 making electrical contact between the primary conductors 13 and laminate 12. Additional insulation 14 is applied over the top of the metal foil laminate wrapping.

Figure 2A:
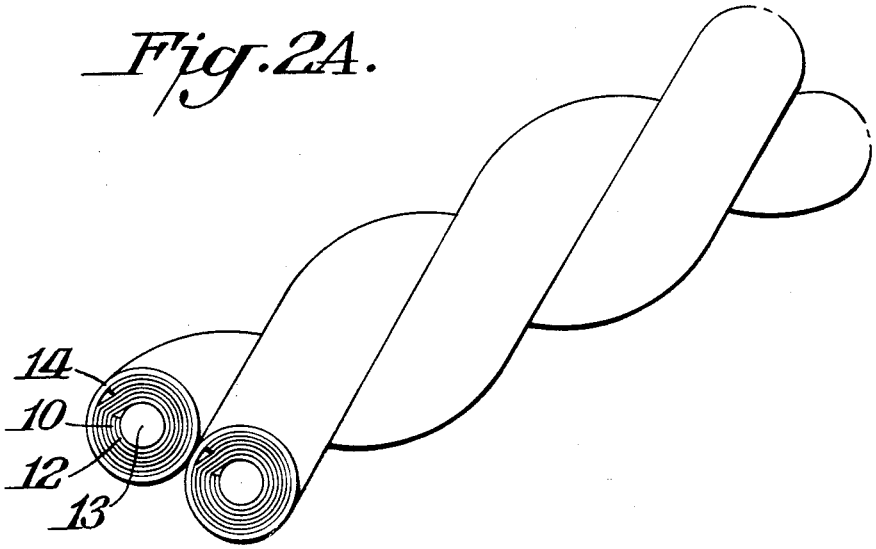
FIG. 2*a* is a pictorial representation of a twisted pair of insulated wires according to the invention.

FIG. 2*a* is a pictorial representation of a twisted pair of insulated wires according to the invention.

FIG. 2 also shows the initial diameter of the primary conductor 13 as being $d_1$. As the conductive metal foil is wrapped around each conductor, the size of the effective electrical diameter is increased and is measured as $d_{eff}$. If the invention is not used, the primary conductor diameter $d_1$ becomes $d_{eff}$. Additional insulation 14 may be applied over the top of the metal foil laminate wrapping. The total diameter of the conductor 13, wrapped conductive foil 12 and outer insulation covering 14 is measured as D. The characteristic impedance Z is logarithmically related to the diameter of the insulated wire by the ratio D/d. Where the invention is used, the diameter of the primary conductor (d) is substituted by $d_{eff}$. Thus, by using the invention, the characteristic impedance is reduced because the effective electrical diameter of the primary conductor is increased.

In a preferred embodiment, the additional insulation 14 may be a polyester film or polyimide based film insulation. This additional insulation may be applied by extrusion or by additional wrapping to a desired outside diameter. Cut-through resistance is increased by the addition of this insulation.

EXAMPLE 1

Existing solderless wrap on a primary conductor and the present invention for a single 50 ohm insulated wire are contrasted. A final outer diameter of wire of 19.6 mils is desired as this is the optimum size for automatic wire stripping equipment.

Using conventional technology, a single 28(1) AWG primary conductor with an actual diameter of 12.6 mils, dielectric constant E=3.1 and a characteristic impedance of 50 ohms, was covered by an outer layer of polyester film insulation. Here, the final diameter of 14.1 mils was attained without increasing the characteristic impedance. A D/d ratio of 1.12 was calculated by referring to FIG. 3.

Using the present invention, a single 28(1) AWG primary conductor of actual diameter 12.6 mils was wrapped with three layers of aluminum foil laminated tape whereby the foil was in constant physical contact with the primary conductor. An outer layer of polyester film insulation was applied over the primary conductor foil combination. The final diameter of this embodiment was 19.6 mils.

By wrapping the foil around the primary conductor, the diameter of the primary conductor of 12.6 mils was increased to an effective electrical diameter of 17.5 mils. The characteristic impedance was maintained at 50 ohms and the resulting wire had a calculated D/d ratio of 1.13.

The following chart summarizes results of the calculated outer wall thickness and cut-through radius of curvature for both conventional solderless wrap on a primary conductor and the present invention.

CHART 1

Comparison Of 28(1) AWG Primary Conductors Using Existing Technology And The Present Invention For 50 ohms Impedance

| | $Z_0$ ohms | d mils | $d_{eff}$ mils | D/d | $D/d_{eff}$ | D mils | Outer Wall mils | Cut-through Radius Of Curvature mils |
|---|---|---|---|---|---|---|---|---|
| Conventional Technology | 50 | 12.6 | — | 1.12 | — | 14.1 | 0.75 | 7.05 |
| Foil-Wrapped | 50 | 12.6 | 17.5 | — | 1.13 | 19.6 | 1.05 | 9.8 |

Wall = (D − d) ÷ 2
Cut-through radius of curvature = D ÷ 2

An insulated wire with an outer wall thickness of 0.75 mils does not fit standard automated stripping machines. The standard wire cutting equipment is not able to cut into, grrab, and pull off the outer wrapping without injury to the primary conductor. Further, a radius of curvature of 7.05 does not meet conventional wire cut-through requirements.

In contrast, the present invention provided a primary conductor with an increased electrical diameter and increased outer wall diameter and cut-through radius of curvatures so that standard automated stripping machines could be used.

EXAMPLE 2

A comparison similar to that described in Example 1 was also made with a 28(1) AWG primary conductor with an actual diameter of 12.6 mils, dielectric constant E=3.1 and a characteristic impedance of 55 ohms. Here the D/d ratio was found to be 1.15 by referring to FIG. 3.

Test data was accumulated and calculations made were similar to those as described in Example 1. Test results are summarized in Chart 2 shown below.

CHART 2

Comparison of 28(1) AWG Primary Conductors Using Existing Technology And The Present Invention For Wire With A Characteristic Impedance of 55 ohms

| | $Z_0$ ohms | d mils | $d_{eff}$ mils | D/d | $D/d_{eff}$ | D mils | Outer Wall mils | Cut-through Radius Of Curvature mils |
|---|---|---|---|---|---|---|---|---|
| Conventional Technology | 55 | 12.6 | — | 1.15 | — | 14.5 | 0.95 | 7.25 |
| Foil-Wrapped | 55 | 12.6 | 17.5 | — | 1.15 | 20.1 | 1.30 | 10.1 |

Wall = (D − d) ÷ 2
Cut-through radius of curvature = D ÷ 2

Here again, one skilled in the art can see that the inventive entity allows the impedance to remain at 55 ohms but the outer wall and cut-through radius are increased (by 39%) and can be used with existing wire stripping equipment.

EXAMPLE 3

Existing solderless wrap of primary conductors and the present invention for a 75 ohm twisted pair of insulated wires are compared. An outside diameter of 19.5 mils is desired as this is the optimum size for the automatic wire-stripping machines.

Figure 3:
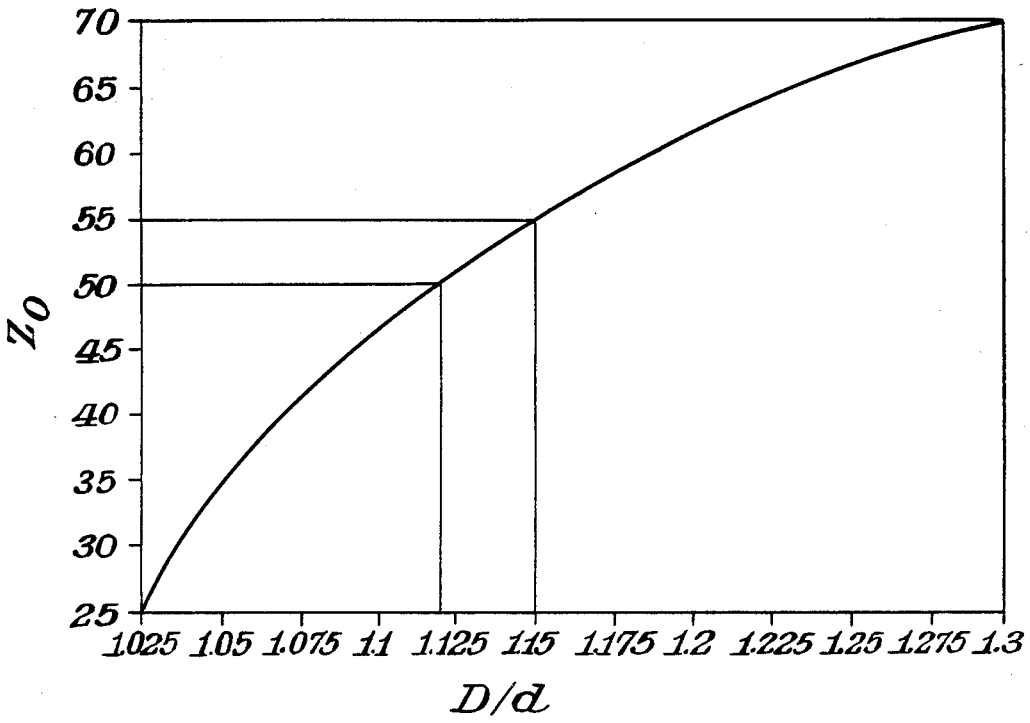
FIG. 3 is a graphical representation depicting the relation between impedance and the ratio D/d where D is the diameter of the insulated wire and d is the actual diameter of the conductor.

Using conventional technology, a pair of 30(1) AWG primary conductors with initial diameters of 10.1 mils, dielectric constant of 3.12, a characteristic impedance of 75 ohms is extrapolated from FIG. 3 to have a D/d ratio of 1.36.

Similarly, a pair of 30(1) AWG primary conductors are individually wrapped with aluminum foil laminated tape so that the foil is in constant physical contact with each primary conductor. Here, the outer diameter D is 19.5 mils, the effective electrical diameter $d_{eff}$ is 14.4 mils, and the ratio of $D/d_{eff}$ is found to be 1.31.

The following chart summarizes physical characteristics of a 30(1) AWG twisted pair using existing art and a twisted pair as constructed by the present invention.

CHART 3

| | 75 ohm Twisted Pair 30(1) AWG | | | | | | | |
|---|---|---|---|---|---|---|---|---|
| | $Z_0$ ohms | d mils | $d_{eff}$ mils | D/d | $D/d_{eff}$ | D mils | Outer Wall mils | Cut-through Radius Of Curvature mils |
| Conventional Technology | 75 | 10.1 | — | 1.36 | — | 13.6 | 1.8 | 6.8 |
| Foil-Wrapped | 75 | 10.1 | 14.4 | — | 1.31 | 19.5 | 2.6 | 9.75 |

Wall = (D − d) ÷ 2
Cut-through radius of curvature = D ÷ 2

In this example, we achieve the desired combination of a 30(1) AWG twisted pair of wires with an outer diameter of 19.5 mils and maintains the desired impedance of 75 ohms. If one were simply to insulate the 30(1) AWG with polyester film insulation to make an outer diameter of 19.5 mils, the characteristic impedance would be 100 ohms.

Also, for a 75 ohm twisted pair 30(1) AWG, the wall thickness has been increased to add cut-through resistance without increasing the characteristic impedance in this invention. Further, the cut-through radius of curvature is increased by 43% and is easily compatible with existing stripping equipment.

It is to be understood that the foregoing description and the accompanying drawings and examples are illustrative of the invention and are not to be taken as limiting the scope of the appended claims.

We claim:

1. An electric transmission wire having low characteristic impedance of less than 100 ohms and high cut-through resistance comprising:
   a. a primary conductor to which is electrically attached a spirally layered continuous conductor of conductive material,
   b. insulating film interleaved between the layers of spiralled conductor; and
   c. an outer layer of insulating material surrounding the layers of spiralled conductor and interleaved insulating film.

2. An article as described in claim 1 wherein said wire has a characteristic impedance less than 75 ohms.

3. An article as described in claim 1 wherein said conductive material and insulating film is aluminum laminated to polyester film.

4. An article as described in claim 1 wherein said conductive material and insulating film is aluminum laminated to expanded PTFE film.

5. An article as described in claim 1 wherein said conductive material and insulating film is aluminum laminated to polyimide film.

6. An electric transmission wire having low characteristic impedance of less than 100 ohms and high cut-through resistance comprising a primary conductor to which is electrically attached a continuous conductor of conductive material further comprising insulating film that is wrapped longitudinally around said primary conductor forming layers and an outer layer of insulating material surrounding the primary conductor and continuous conductor of conductive material.

7. A twisted pair of electric transmission wires having low characteristic impedance of less than 100 ohms and high cut-through resistance comprising:
   a. two primary conductors to which each is electrically attached a spirally layered continuous conductor of conductive material,
   b. insulating film interleaved between the layers of the spiralled conductor surrounding each of the primary conductors; and
   c. an outer layer of insulating material surrounding the layers of the spiralled conductor and interleaved insulating film of each transmission wire, said wires twisted together into a twisted pair.

* * * * *